United States Patent [19]

Arnold et al.

[11] Patent Number: 4,646,842

[45] Date of Patent: Mar. 3, 1987

[54] RETRIEVABLE WELL BORE ASSEMBLY

[75] Inventors: Ronald D. Arnold; Samuel F. Baker; Billy R. Goodman, all of Houston, Tex.

[73] Assignee: Texas Iron Works, Inc., Houston, Tex.

[21] Appl. No.: 602,538

[22] Filed: Apr. 20, 1984

[51] Int. Cl.[4] ..... E21B 43/10

[52] U.S. Cl. ..... 166/382; 166/124; 166/240

[58] Field of Search ..... 166/124, 125, 240, 382, 166/387

[56] References Cited

U.S. PATENT DOCUMENTS

| | | | |
|---|---|---|---|
| 3,448,806 | 6/1969 | Berryman et al. | 166/124 |
| 4,388,971 | 6/1983 | Peterson | 166/387 |
| 4,399,873 | 8/1983 | Lindsey, Jr. | 166/387 |
| 4,440,244 | 4/1984 | Baugh et al. | 166/382 |
| 4,479,548 | 10/1984 | Gilbert | 166/387 |
| 4,489,781 | 12/1984 | Weeks | 166/208 |
| 4,513,822 | 4/1985 | Gilbert | 166/382 |

*Primary Examiner*—Stephen J. Novosad
*Assistant Examiner*—William P. Neuder
*Attorney, Agent, or Firm*—Jack W. Hayden

[57] ABSTRACT

Apparatus and method of positioning and seating a retrievable insert landing assembly in a well bore tubular member with a left-hand threaded portion and having a sealing bore above or below the threaded portion. A releasable connecting arrangement secures the landing assembly in a well bore tubular member by engaging with the left-hand threaded portion in the tubular member. The landing assembly has an internal polished bore above the connecting arrangement which slidably and sealingly receives a tubular extension attached to a well string. The connecting arrangement is actuated by lowering the retrievable landing assembly within the tubular member to position the connecting arrangement adjacent the left-hand threaded portion and then lifting up on the landing assembly to lock it with the left-hand threaded portion. The well string is manipulated to actuate the releaseable coupling and disconnect the well string from the landing assembly after it is connected with the tubular member. To retrieve the landing assembly, the well string is manipulated to reconnect it with the retrievable landing assembly. The well string is then manipulated to actuate the connecting arrangement to disconnect the retrievable landing assembly from the tubular member so that it may be retrieved. Thus, the retrievable insert landing assembly is mechanically set and mechanically retrieved merely by manipulating the well string on which the landing assembly is lowered into the well bore.

22 Claims, 7 Drawing Figures

RETRIEVABLE WELL BORE ASSEMBLY

FIELD OF THE INVENTION

This invention relates to oil and gas well production tools for use in a well bore tubular member, and more particularly to a retrievable well bore assembly which can be automatically positioned in a well bore tubular member having an internal left-hand threaded portion above and/or below a seal bore merely by manipulating the well string on which the retrievable well bore assembly is lowered into the well bore.

This application relates generally to subject matter disclosed in co-pending application Ser. No. 729,231 filled on May 1, 1985 for "Tubular Member Anchoring Arrangement and Method" and patent application Ser. No. 729,733 filled on May 2, 1985 for "Retrievable Landing Method and Assembly for a Well Bore", both of which are assigned to the assignee of the invention disclosed herein.

DESCRIPTION OF THE PRIOR ART

U.S. Pat. No. 4,399,873 issued on Aug. 23, 1983 is representative of the prior art. Also, the references to the Composite Catalog of Oil Field Equipment referred to therein are representative of the prior art.

A major problem with the apparatus and method of U.S. Pat. No. 4,399,873 is that it requires the injection of liquid into the well along with a closure device to actuate the mechanism. Well operators are not desirous of introducing objects or liquids into a well bore, if such can be avoided.

Another objection with the apparatus and arrangement as described in U.S. Pat. No. 4,399,873 and other prior art devices is that they can only be employed in well bores in which the tubing or tubular member in which the device is to be received has been previously provided with a groove or profile of predetermined configuration and arrangement before lowering the tubing or tubular member into the well bore.

Many oil and gas well pipe strings do not have a "Packer Bore Receptacle" (PBR) therein, nor do they have a groove or profile at the desired location to receive a retrievable insert landing assembly. Thus, to utilize the apparatus and method of U.S. Pat. No. 4,399,873 and the other prior art, it is necessary to either withdraw the production tubing or tubular member into which the landing assembly there described is to be employed and cut a groove in the tubular member and then to relower it into the well bore to receive the apparatus of U.S. Pat. No. 4,399,873. This would be extremely time consuming and eliminate the purported advantages of such prior art devices.

Generally speaking, when liners are positioned in a well bore to form an extension of the well casing at the lower end thereof, they are set in the casing in a manner and by an arrangement so that a left-hand thread is formed thereon and generally adjacent the upper end thereof. In some instances, the liners are provided with packer bore receptacles, and in some instances, they are not.

Accordingly, it is an object of the present invention to provide a method and apparatus for setting production tools, and specifically for setting a retrievable well bore landing assembly in a well without requiring the use of a special cut profile or latch receiving groove and without requiring the injection of a closure device or liquid into the well.

DESCRIPTION OF THE PRESENT INVENTION

The present invention includes a retrievable insert landing assembly which is insertable through a string of pipe in a well bore and which automatically positions itself in the bore of the production string, which provides a seal bore with a left-hand internal thread thereabove and/or therebelow.

The landing assembly includes releasable connecting means which engages the left-hand thread in the production string and continued lowering of the landing assembly relative to the connecting means causes the connecting means to ratchet over the left-hand threaded portion and thereafter the landing assembly may be raised so that the connecting means is engaged with and is maintained engaged with the left-hand threaded portion in the production string or tubular member. Tubular extension means is slidably and sealingly received in the tubular mandrel of the landing assembly above the releasable connecting means and tool means releasably couple the well string and tubular extension means to the upper end of the tubular mandrel of the landing assembly with the tool means being operable upon rotation to release the well string and tubular extension means from the landing assembly for sliding and sealing movement therebetween.

Seal means on the landing assembly slidably and sealably engage a packer bore receptacle (PBR), when such is provided on the liner, or production string, beneath the left-hand thread, or merely sealably engage in the bore of the tubular member in which the landing assembly is received.

The landing assembly includes longitudinally extending keys to prevent relative rotation between the releasable connecting means and the landing assembly when engaged with the left-hand threads so that upon right-hand rotation of the well string the connecting means may disengage from the left-hand threads so that the landing assembly may be retrieved from the well.

DESCRIPTION OF THE PREFERRED EMBODIMENT

Figure 1:
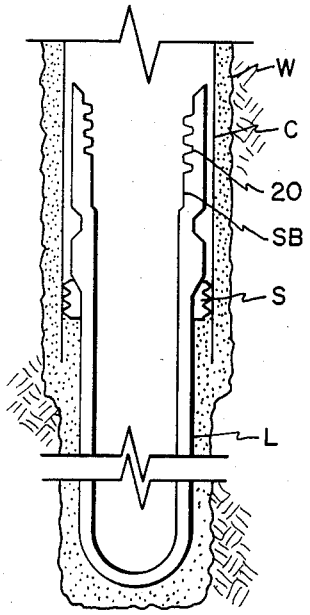
FIG. 1 is a schematic view of a liner hung in a casing in a well bore, with the liner having a polished bore adjacent its upper end and an internal left-hand thread portion thereabove.

FIG. 1 illustrates a well bore W in which a casing C is positioned with a liner L having a seal bore SB secured or positioned to the casing C by the slip means S in a manner well known to those skilled in the art. The casing C and liner L are positioned in the well bore W and one general method employed to position the liner L in the casing C employs a setting tool which is releasably connected to the liner L by a left-hand threaded portion as illustrated at 20 at the upper end thereof. After the liner is positioned in the casing, the setting tool is disconnected from the liner, cementing operations are completed, and the setting tool is then removed from the well bore.

The liner may be provided with a seal bore above or below the left-hand threads 20 of the liner L. The retrievable insert landing assembly is preferably employed with a tubular member having a polished bore and a left-hand threaded portion thereabove, but may be employed with any tubular member in which is formed a left-hand thread whether or not a polished bore is secured in the tubular member.

The retrievable insert landing assembly referred to generally at 15 is lowered into the well bore on a well string as represented at 25, and tool means referred to generally at 26 releasably couple a tubular extension 27 formed on the lower end of the well string 25 with a tubular mandrel 28 forming part of the retrievable insert landing assembly.

Figure 2B:
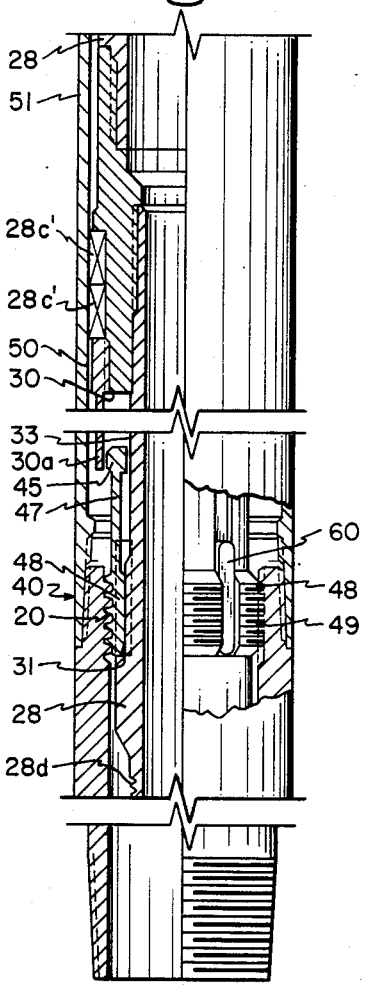
FIG. 2B is a longitudinal quarter sectional view, partly broken away and partly in elevation, similar to FIG. 2A, but showing the seal means sealably engaging above the left-hand thread.
Figure 2:
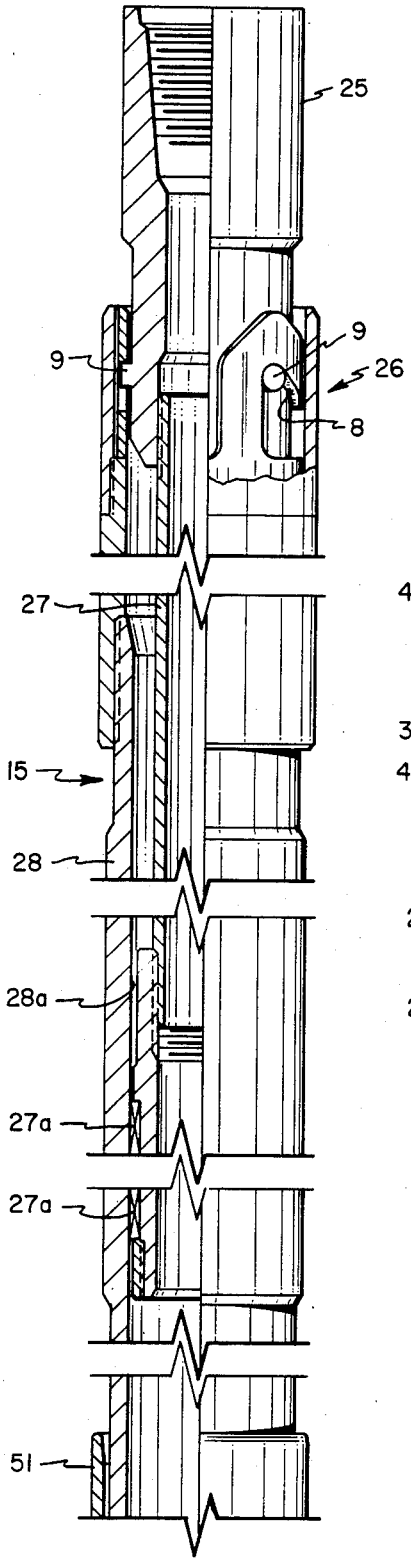
FIG. 2 is a quarter sectional view partly in elevation and partly broken away of the upper portion of the landing assembly illustrating tool means releasably coupling a tubular extension with the upper end of the retrievable insert landing assembly.
Figure 2A:
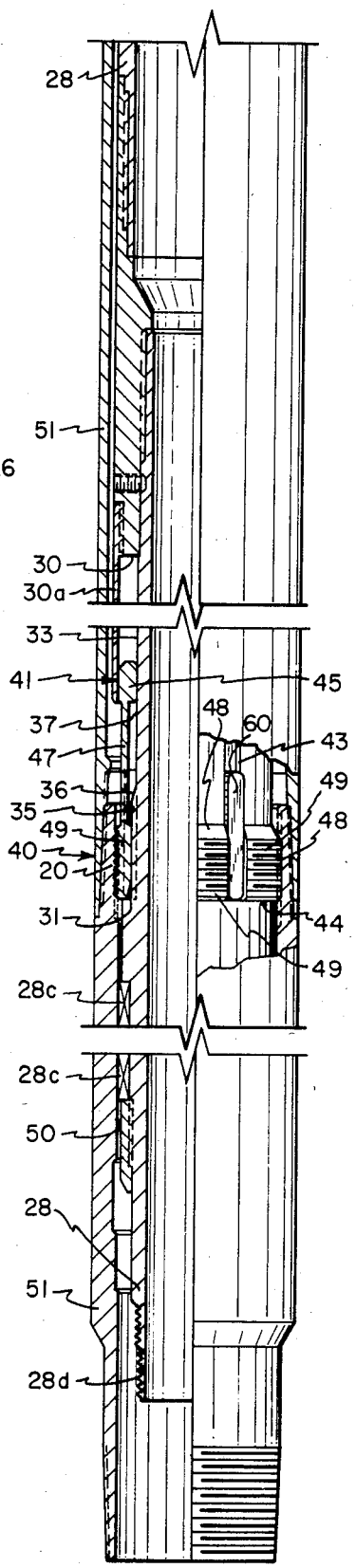
FIG. 2A is a continuation of the retrievable insert landing assembly shown in FIG. 2, partly in elevation, and illustrating in greater detail the arrangement of the releasable connecting means for securing the retrievable insert landing assembly wth a tubular member in the well bore.

In the embodiment shown in FIG. 2A, upper and lower shoulders 30, 31 are longitudinally spaced from each other on the outer surface of the tubular mandrel 28 to define an external annular recess 33 between the shoulders. The recess 33 has an enlarged outer diameter 35 adjacent the lower shoulder 31 as shown, which enlarged diameter is larger in diameter than the diameter of the remainder 37 of recess 33. The enlarged outer diameter portion 35 is provided with an annular tapered end portion 36 which connects with the smaller diameter portion 37 of the recess 33 extending up to the upper shoulder 30.

Releasable connecting means referred to generally at 40 include an annular collar referred to generally at 41 which is slidably received in the annular recess between the shoulders 30 and 31. A skirt **30*a* is secured to mandrel 28 and extends downwardly from shoulder 30 in annular spaced relation to recess 33 to act as a guide for collar 41. The collar 41 includes longitudinally extending and circumferentially spaced slots 43 extending from the lower end 44 of the collar 41 and terminate at the annular ring 45 formed at the upper end of the collar 41 as shown. The longitudinal portions of the collar 41 between the longitudinally extending, circumferentially extending slots 43 are formed to provide flexible extensions or portions 47 which extend from the ring 45 and terminate in the enlarged portions or segments 48 having the external threaded surface 49 formed thereon to define the lower end of collar 41**.

The tubular mandrel 28 preferably has incorporated therein a seal bore **28*a* above the connecting means 40 as illustrated for slidably and sealably receiving the seals 27*a* carried by the tubular extension 27. Also, the tubular mandrel 28 is provided with seal means 28*c* below the coupling means 40 for slidably and sealingly engaging with the sealing bore 50 of the tubular member 51. Further, the lower end of the tubular mandrel 28 can be provided with threads as illustrated at 28*d* so that a tailpipe, or a landing profile of any suitable configuration, may be secured to the tubular mandrel 28 and lowered with the retrievable insert landing assembly 15** if desired.

FIGS. 2 and 2A demonstrate the relationship of the retrievable insert landing asembly of the present invention after it has been lowered into the tubular member, such as a liner L or the like in a well bore with a left-hand thread 20 thereon above a seal bore and with the connecting means 40 actuated to secure the retrievable insert landing assembly 15 of the present invention in position with the tubular member 51.

Figure 3:
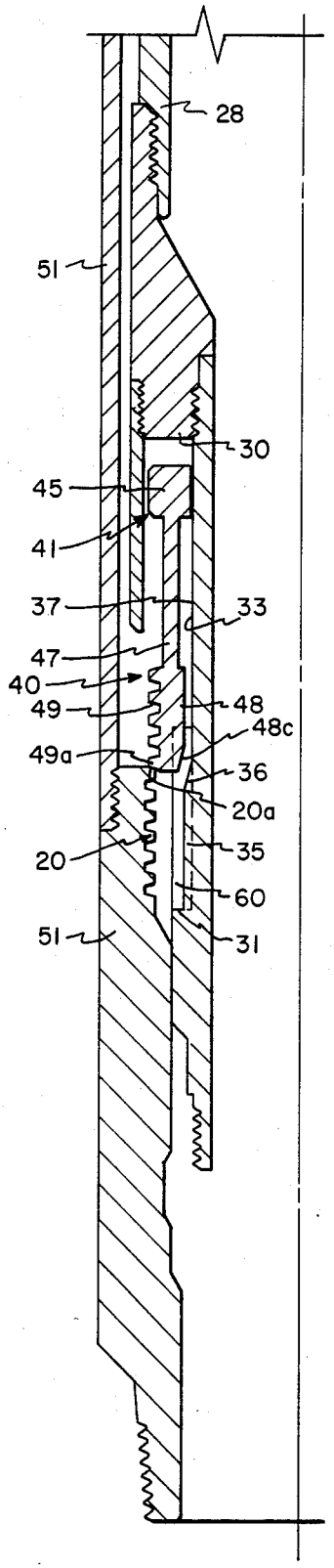
FIGS. 3, 4 and 5 are fragmentary sectional views to diagrammatically and stepwise illustrate the actuation of the connecting means to secure the retrievable insert landing assembly in the well bore tubular member.
Figure 4:
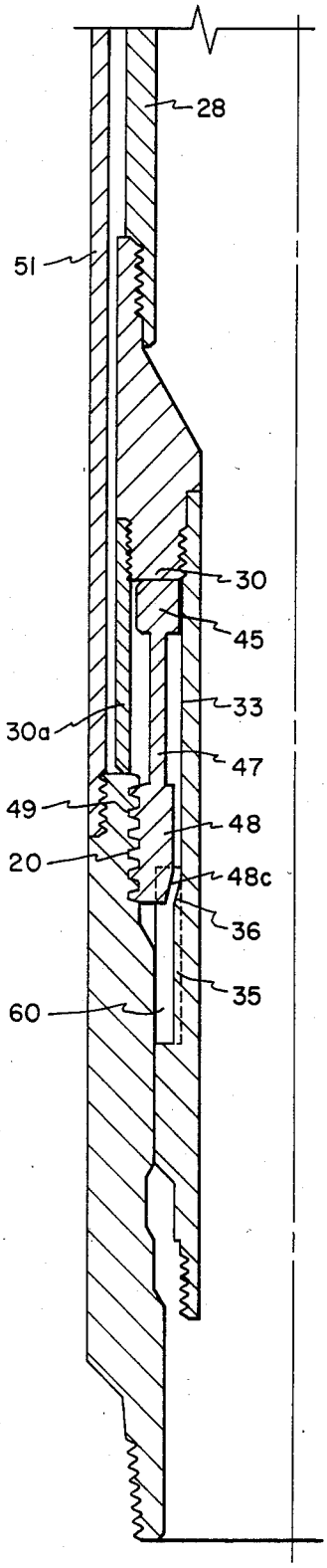
Figure 5:
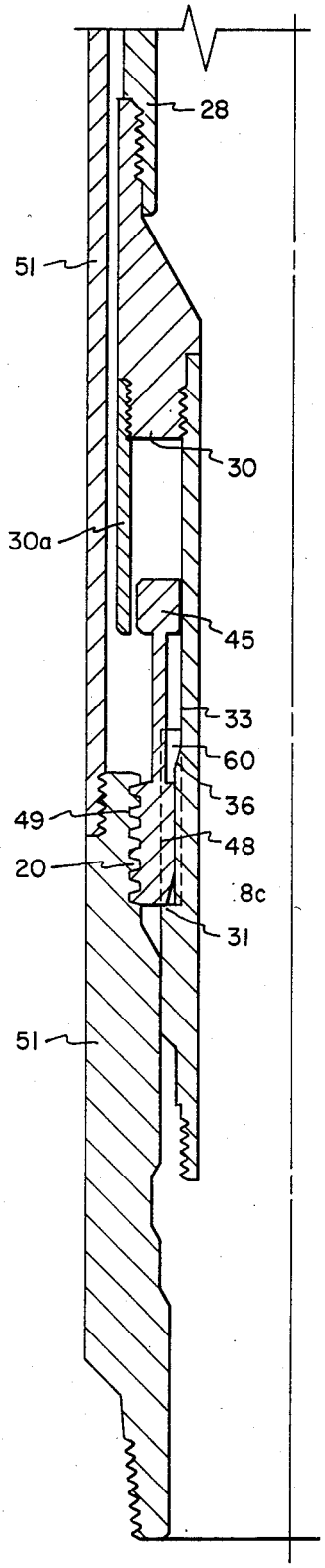

FIGS. 3, 4 and 5 diagrammatically illustrate the operation of the connecting means 40 forming part of the retrievable insert landing assembly 15 for securing the retrieving insert landing assembly with the tubular member 51 in the well bore.

FIGS. 2–5 omit the well bore, but it can be appreciated that a tubular member, such as a liner L with a left-hand thread 20, is positioned in a well bore as illustrated in FIG. 1.

The well string 25 with the retrievable insert landing assembly 15 is lowered into the well bore W, and more specifically, is lowered into a tubular member 51 such as the liner L in which it is to be secured. When the retrievable insert landing assembly 15 is lowered by the well string 25 into the tubular member 51, the lowermost thread **49*a* on each of the enlargements 48 of the collar 41 initially engages the uppermost thread 20*a* on the threaded portion 20 of the tubular member 51. Continued lowering of the landing assembly 15 including the tubular mandrel 28 thereof causes the shoulder 30 to engage ring 45 of collar 41 and move the collar 41 as mandrel 28 is lowered by the well string 25. This collapses extensions 47 inwardly so that the enlargements 48 move radially in the recess 33 to enable the threads 49 to ratchet over and longitudinally along the threads 20 on tubular member 51 to automatically engage therewith as represented in FIG. 4** of the drawings.

Thereafter, the well string 25 and tubular mandrel 28 connected therewith, is lifted upwardly relative to collar 41. Tapered end surface 36 of recess 33 contacts annular tapered surface **48*c* on the lower end of segments 48 and aligns and abuts the enlarged outer diameter portion 35 of the recess 33 with the segments 48 of the collar 41 to maintain the threads 49 thereon engaged or locked with the threads 20 of the tubular member 51 as shown in FIGS. 2A and 5**.

Disengagement or release of the landing assembly 15 from tubular member 51 is effected as follows. Longitudinally extending circumferentially spaced keys 60 are formed on the tubular member 28 in the recess adjacent the lower shoulder 31 as shown in FIGS. 2A and 2–5 of the drawings. These keys extend radially into the slots 43 between the circumferentially spaced, threaded segments 48 and extensions 47 of the collar 41. Right-hand rotation of the well string 25 rotates the tubular mandrel 28 and in turn the collar 41 through the interengaged keys 60 carried by the tubular mandrel 28 and slots 43 of the collar 41 so that the collar 41 backs out or disengages from the left-hand threaded surface 20 of tubular member 51. Thereupon, the retrievable landing assembly 15 may be retrieved from the well bore. The foregoing illustrates one form of cooperating means on the tubular mandrel and connecting means to effect connection and disconnection of the retrievable landing assembly 15 with the tubular member 51.

The tool means 26 includes diametrically opposed "J" slots 8 formed in the upper end of the tubular mandrel 28. Opposed pins 9 projecting from and carried by the well string 25 are engageable and disengageable with the "J" slots 8 to connect the well string 25 with the retrievable well bore assembly 15 as desired. More specifically, the pins 9 and "J" slots 8 when engaged as shown in FIG. 2 of the drawings may be disengaged by lowering the well string 25 and rotating it one-half turn to the left. This enables the tubular extension 27 to remain slidably and sealably connected with seal bore 28*a* of the retrievable well bore assembly, and the well may be produced through well string 25, if desired. This eliminates the necessity of interrupting production to remove well string 25 and then replacing it with a different well string, or production string.

From the foregoing, it can be seen that the present invention provides a retrievable insert landing assembly which can be positioned in a tubular member in a well bore having a seal bore with a left-hand thread above or below the bore. It can also be employed in a tubular member which has a left-hand thread at the upper end thereof and in which tubular member it is desired to position a packer bore receptacle. The present invention can be utilized without the necessity of a special profile or groove for receiving latching members and automatically latches in place merely by lowering the well string, when the insert assembly is positioned in the tubular member, and thereafter raising the well string to actuate the connecting means to releasably secure the retrievable well bore assembly in the tubular member.

Where it is desired to use the well string which lowers the retrievable well bore assembly into the tubular member as a production string for the well, the well string may be manipulated so that the tool means is disengaged between the well string and the insert assembly by rotating the well string to enable the pins 9 to disengage from the slots 8 to thereafter accommodate longitudinal movement of the well string slidably and sealably within the tubular mandrel 28.

While the term "polished bore" or "seal bore" is employed herein, it is to be understood that the tubular member 51 may be provided only with an ordinary bore in which packing or seals carried by the retrievable well bore assembly may be sealingly engaged, and these terms are intended to also include an ordinary bore.

In FIG. 2B, the retrievable well bore assembly 15 is shown in the same relationship in tubular member 51 as it is in FIG. 2A and like reference numerals are employed for like parts; however, the seal bore 50 is shown above the left-hand threaded portion 20 and seals 28*c*' are sealably engaged with the bore 50 above the left-hand threaded portion 20. In some instances it may be desirable to provide a seal bore 50 above and below the left-hand threaded portion 20 with suitable seal means on the retrievable well bore assembly to engage therewith.

The foregoing disclosure and description of the invention are illustrative and explanatory thereof, and various changes in the size, shape and materials as well as in the details of the illustrated construction may be made without departing from the spirit of the invention.

What is claimed is:

1. A method of setting and retrieving with a well string including a releasable coupling which supports a retrievable insert landing assembly having connecting means and seal means for engaging with the seal bore in a well bore tubular member having an internal left-hand threaded portion comprising the steps of:

lowering the well string and coupling tool connected with the retrievable insert landing assembly into the well bore until the landing assembly seal means is sealingly received in the seal bore of the tubular member;

manipulating the well string to secure the connecting means and retrievable insert landing assembly with the left-hand threaded portion on the tubular member; and maintaining the connecting means and retrievable insert landing assembly secured with the left-hand threaded portion on the tubular member while uncoupling the well string from the retrievable insert landing assembly and while maintaining the well string and retrievable insert landing assembly interconnected to provide a sliding seal therebetween and capable of recoupling for retrieval of the insert landing assembly.

2. In a retrievable landing assembly for lowering on a well string to use in a well bore tubular member having a seal bore with an internal left-hand threaded portion, the invention including:

a tubular mandrel for connecting the tubular member;

seal means on said tubular mandrel for sealably engaging with the seal bore in the tubular member;

upper and lower shoulders on said tubular mandrel defining an annular recess having an enlarged diameter adjacent the lower shoulder which is larger than the recess diameter thereabove;

releasable connecting means on said mandrel including a collar slidably carried in the recess, said collar having longitudinal and circumferentially spaced slots extending from one end forming segments, said segments having threads thereon;

said releasable connecting means engageable with the left-hand threaded portion of the tubular member by first lowering the tubular mandrel to enable said threaded segments to ratchet over the left-hand threaded portion on the tubular member and then elevating the tubular mandrel so that the enlarged diameter on the recess abuts said segments to maintain them threadedly engaged with the left-hand threaded portion on the tubular mandrel;

tubular extension means connected with the well string and including seal means to slidably and sealingly receive the upper end of said tubular mandrel above said releasable connecting means; and tool means operative upon rotation of the well string to uncouple between said tubular extension means and tubular mandrel while retaining them slidably and sealably interconnected for subsequent recoupling by the well string.

3. The retrievable insert landing assembly of claim 2 wherein said tool means includes opposed "J" slots in the upper end of the tubular mandrel and opposed pins carried by the well string which are disengagable from said "J" slots by rotating the well string.

4. The retrievable insert landing assembly of claim 2 wherein threads are formed on the lower end of said tubular mandrel.

5. The retrievable insert landing assembly of claim 2 including tool means to recouple the well string and tubular member and further including longitudinal, circumferentially spaced keys on said mandrel extending from said lower shoulder in the recess and projecting into the slots between said segments whereby rotation of said mandrel threadedly disengages said segments from the left-hand internal threaded portion on the tubular member and releases the retrievable insert assembly for removal from the tubular member.

6. The landing assembly of claim 2 wherein said seal means on said mandrel is above or below the left-hand threaded portion.

7. In a retrievable insert landing assembly for lowering on a well string to use in a well bore tubular member having an internal left-hand threaded portion, the invention including:

a tubular mandrel sealingly receiving the well string therein at one end;

releasable connecting means on said tubular mandrel engagable with the left-hand threaded portion of the tubular member;

said releasable connecting means including means to lock said tubular mandrel with the left-hand threaded portion on the tubular member;

said means to lock including an annular recess on said mandrel having an enlarged diameter end portion and a segmented collar slidably supported in the recess and having threads for engaging with the left-hand threaded portion on the tubular member, said threaded, segmented collar ratcheting into engagement with the tubular member left-hand threaded portion upon lowering of said tubular mandrel, with said enlarged diameter of the recess abutting said threaded, segmented collar by elevating the tubular mandrel to maintain said threaded, segmented collar in threaded engagement with the tubular member;

said releasable connecting means further including means to unlock said releasable connecting means for the tubular member left-hand threaded portion;

said means to unlock including means carried by said tubular mandrel to restrain said segmented collar against rotation relative to said tubular member when said collar is engaged with the left-hand threaded portion whereby right-hand rotation of said tubular mandrel moves said collar longitudinally to disengage from the left-hand threaded portion;

coupling means coupling the well string to said tubular mandrel, said coupling means releasable by rotation of the well string after said mandrel is engaged with the tubular member to accomodate sealing relative longitudinal movement therebetween; and coupling means to recouple the well string with said tubular mandrel for rotation thereof to actuate said means to unlock said releasable connecting means.

8. The invention of claim 7 wherein said coupling means include opposed "J" slots in said tubular mandrel and opposed pins carried by the well string which are disengageable from said "J" slots by rotating the well string.

9. A method of setting and retrieving with a well string including a releasable coupling having seal means which supports a retrievable landing assembly having connecting means and seal means for engaging in a well bore tubular member comprising the steps of:

coupling the well string to extend slidably and sealably into the upper end of the retrievable landing assembly;

lowering the well string and retrievable landing assembly into the well bore;

manipulating the well string to position the retrievable landing assembly seal means sealably within the tubular member and to actuate the connecting means for connecting the retrievable landing assembly with the tubular member; and maintaining the retrievable landing assembly connecting means connected with the tubular member while uncoupling the well string from the retrievable landing assembly and while maintaining the well string and retrievable landing assembly sealably interconnected and capable of recoupling for retrieval of the retrievable landing assembly by the well string.

10. A method of setting, locking and unlocking a retrievable landing assembly having threaded connecting means and seal means thereon by a well string with a coupling tool thereon in a well bore tubular member with an internal left-hand threaded portion, comprising the steps of:

lowering the retrievable landing assembly on the well string and coupling tool into a well bore tubular member until the retrievable landing assembly is sealingly received in the well bore tubular member;

threadedly engaging the connecting means with the left-hand threaded portion on the tubular member without rotating the well string to effect the engagement;

moving the well string longitudinally to lock the retrievable landing assembly in the tubular member; and manipulating the well string to uncouple from the retrievable landing assembly while maintaining the connecting means and threaded portion on the tubular member connected and while maintaining the well string coupling tool and retrievable landing assembly interconnected for providing a sliding seal therebetween and capable of recoupling for retrieval of the retrievable landing assembly from the well bore tubular member.

11. A retrievable landing assembly for lowering on a well string in a well bore tubular member having a seal bore with an internal left-hand threaded portion including:

seal means and connecting means on the retrievable land assembly for sealingly engaging in the seal bore of the tubular member and for connecting with the tubular member left-hand threaded portion, respectively;

means operable by manipulating the well string after the retrievable landing assembly connecting means is connected with the tubular member threaded portion to uncouple the landing assembly from the well string while retaining the well string and landing assembly sealingly interconnected for relative longitudinal movement therebetween and while maintaining said landing assembly connecting means connected with the tubular member; and means operable by manipulating the well string to recouple the well string and landing assembly whereby the landing assembly may be disconnected from the tubular member by further manipulating the well string.

12. A method of lowering on a well string and connecting a landing assembly to the left-hand threaded portion on the internal wall forming the unrestricted bore of a liner that is a fluid production string extending from the lower end of a well bore casing so that the bore remains unrestricted when the landing assembly is removed comprising the steps of:

releasably supporting the landing assembly on the well string;

providing an external threaded surface and seal means on the landing assembly;

manipulating the well string to seal the landing assembly in position for conducting fluid from the production string to the well string and to threadedly secure it to the left-hand threaded portion on the internal wall forming the production string unrestricted bore; and manipulating the well string to uncouple the landing assembly from the well string while maintaining the landing assembly threadedly secured with the production string.

13. A retrievable landing assembly for supporting on a well string for securing the landing assembly with an internal left-hand threaded portion on the internal wall of a production string in a well to seal with the unrestricted bore formed by the internal wall so that the bore remains unrestricted when the landing assembly is removed including:

a tubular mandrel;

seal means on said tubular mandrel for sealably engaging with the internal wall forming the unrestricted bore in the production string;

releasable connecting means on said mandrel for connecting with the left-hand internal threaded portion on the internal wall forming the production string unrestricted bore; and coupling means releasably coupling the well string to extend into the upper end of said mandrel and having seal means therebetween, said coupling means operable by the well string to release the well string from said mandrel while maintaining said mandrel and well string interconnected to provide a sealing relationship therebetween and while maintaining said releasable connecting means on said mandrel connected with the left-hand threaded portion on the internal wall forming the production string unrestricted bore.

14. The landing assembly of claims 11 or 13 wherein the seal means that engages the seal bore is above or below the connecting means.

15. In a retrievable landing assembly for lowering on a well string for use in a well bore tubular member having a seal bore and an internal left-hand threaded portion, the invention including;

a tubular mandrel;

seal means on said tubular mandrel for sealably engaging with the seal bore in the tubular mandrel;

connecting means supported by said mandrel for connecting with the left-hand threaded portion of the tubular member;

tubular extension means connected with the well string and sealingly received in said tubular mandrel above said connecting means; and coupling means for releasably coupling the well string and said tubular extension means to said tubular mandrel, said coupling means being operable by manipulation of the well string to release the well string and said tubular extension means from said tubular mandrel while maintaining them interconnected to provide a sealing relationship therebetween and capable of recoupling the retrieval of the landing assembly and while maintaining said mandrel connecting means connected with said threaded portion of the tubular member.

16. The retrievable landing assembly of claim 15 wherein said seal means is above or below the left-hand threaded portion.

17. A method of sealably connecting a retrievable landing assembly having seal means and connecting means in a well bore tubular member comprising the steps of:

sealably and releasably coupling a well string to extend into the upper end of the retrievable landing assembly;

lowering the well string and retrievable landing assembly into the well bore;

manipulating the well string to position the seal means sealably within the tubular member and to actuate the connecting means for connecting the retrievable landing assembly in the tubular member; and manipulating the well string to uncouple from the retrievable landing assembly while maintaining the well string extending into the upper end thereof to provide a sliding seal therebetween and capable of recoupling with the retrievable landing assembly and while maintaining the retrievable landing assembly connecting means connected with the tubular member.

18. The method of claims 12 or 17 including the additional step of manipulating the well string to disconnect the landing assembly for removal with the well string.

19. A retrievable landing assembly for lowering on a well string to connect with a tubular member, comprising:

a tubular mandrel, seal means on said mandrel for sealably engaging the tubular member;

connecting means on said mandrel for connecting with the tubular member;

coupling means releasably coupling the well string to extend into said mandrel;

seal means between said mandrel and the well string; and said coupling means responsive to manipulation of the well string to release the well string from said mandrel while maintaining said connecting means connected to the tubular member whereby said mandrel and the well string are maintained in sliding, sealing relationship and capable of recoupling for disconnecting the landing assembly from the tubular member.

20. The landing assembly of claims 11, 13 or 19 wherein threads are formed adjacent the lower end of the landing assembly.

21. The landing assembly of claim 19 wherein said seal means on said mandrel is above or below said connecting means.

22. The landing assembly of claim 21 wherein said connecting means comprises a threaded portion on said mandrel.

* * * * *

UNITED STATES PATENT AND TRADEMARK OFFICE

CERTIFICATE OF CORRECTION

PATENT NO. : 4,646,842

DATED : March 3, 1987

INVENTOR(S) : Ronald D. Arnold, Samuel F. Baker and Billy R. Goodman

It is certified that error appears in the above-identified patent and that said Letters Patent are hereby corrected as shown below:

Column 7, line 36, "for" should be --from--.

Column 10, line 2, "the" should be --for--.

Signed and Sealed this

Eighteenth Day of August, 1987

*Attest:*

DONALD J. QUIGG

*Attesting Officer*

*Commissioner of Patents and Trademarks*